US005382870A

United States Patent [19]

Thoms

[11] Patent Number: 5,382,870

[45] Date of Patent: Jan. 17, 1995

[54] STACKABLE APERTURE MASKS

[75] Inventor: Roland H. Thoms, Cortland, N.Y.

[73] Assignee: BMC Industries, Inc., Bloomington, Minn.

[21] Appl. No.: 947,382

[22] Filed: Sep. 21, 1992

[51] Int. Cl.[6] ..... H01J 29/07

[52] U.S. Cl. ..... 313/402; 313/403

[58] Field of Search ..... 313/402, 403, 408

[56] References Cited

U.S. PATENT DOCUMENTS 3,916,243 10/1975 Brown ..... 313/403
4,048,536 9/1977 Brown ..... 313/403
4,300,069 11/1981 Nolan ..... 313/403

FOREIGN PATENT DOCUMENTS 0472194 2/1992 European Pat. Off. ..... H01J 9/14
0238003 10/1987 Japan .
0025201 1/1990 Japan .

*Primary Examiner*—Donald J. Yusko
*Assistant Examiner*—Ashok Patel
*Attorney, Agent, or Firm*—Kinney & Lange

[57] ABSTRACT

A shadow mask for use in forming a television tube having a plurality of openings therein with the mask grade side having an average centerline roughness $R_{ag}$, which is less than cone side average centerline roughness $R_{ac}$ so that when a plurality of aperture masks are stacked with the grade side of one mask in contact with the cone side of an adjacent mask, the greater roughness of the cone side provides sufficient spacing between the shadow masks to allow gasses to enter between the stacked masks to permit batch annealing of the stack of masks without having the stacked masks adhere to one another during the annealing process.

7 Claims, 2 Drawing Sheets

STACKABLE APERTURE MASKS

FIELD OF THE INVENTION

This invention generally relates to shadow masks and more particular to a method of making high acuity shadow masks that do not adhere to each other during the annealing process.

BACKGROUND OF THE INVENTION

In a colored cathode ray picture tube a shadow mask or aperture mask is located between the electron guns at the rear of the tube and the phosphor mated face plate at the front of the tube. Electron beams pass through tiny openings or apertures in the shadow mask and impinge upon suitable color producing phosphor dots, a triad one dot for each of the three primary colors. During operation of the picture tube the shadow mask openings are used as a guide for the electron beams.

In order to manufacture the shadow masks for use in the cathode my tubes that are used in color monitors it is necessary to proceed through a number of steps to etch a metal web into a shadow mask having the small precision openings of proper dimensions and proper location. In a typical shadow mask manufacturing process one makes a photographic printing plate with a glass base. The photographic printing plate is referred to as a photo printing plate and it contains a master pattern for use in projecting an etchant resist pattern in a layer of etchant resist such as caesin resist which is located on the surface of a metal web. Subsequently, openings are etched in the metal web and the metal web is separated into individual shadow masks which are stacked for batch annealing.

One of the problems with etching shadow masks is how to make the openings in the mask or the acuity as sharp as possible without having the shadow masks adhere to each other during the batch annealing process. Generally, the greater the roughness and skewness on the surface of the mask the less the acuity of the apertures in the mask. On the other hand, unless the roughness on the surface of the shadow mask exceed certain levels the shadow masks adhere to each other during the batch annealing process resulting in destruction of the shadow masks.

One method of overcoming the seizing process during annealing is described in Derwent Abstract of patent application. The abstract describes shadow masks which are annealed and stacked. To prevent the shadow masks from seizing during annealing the inventor imparts a minimum specific roughness and specific skewness to the opposite sides of the metal. To avoid seizing of the masks the Dement Abstract suggests that the average centerline roughness ($R_a$) should have a value between 0.3 to 0.7 microns. Unfortunately, such surface roughness values produce aperture masks with less overall acuity.

The present invention provides a means for producing shadow masks with high acuity, while still permitting batch annealing of the shadow mask. To obtain the high acuity while maintaining the ability to batch anneal the present invention utilizes shadow masks with the surface roughness on the cone side sufficiently larger than the surface roughness on the grade side of the shadow mask to allow gasses between the stacked masks during the annealing process. The surface roughness on the grade side of the mask is sufficiently small so that when the mask is printed and etched, the apertures have a high acuity. By having a larger portion of the surface roughness on the cone side of the mask then on the grade side of the mask one can maker a high acuity opening in the aperture mask while still maintaining the ability to batch anneal the shadow masks.

SUMMARY OF THE INVENTION

A shadow mask for use in forming a television tube comprising a sheet of metal having a plurality of openings therein with the sheet of metal having a cone side on one side of the sheet of metal and a grade side on the opposite side of the sheet of metal with the grade side having an average centerline roughness $R_a$, which is less than cone side average centerline roughness $R_{ac}$ so that when a plurality of aperture masks are stacked with the grade side of one mask in contact with the cone side of an adjacent mask, the combined roughness of the cone side and the grade side provides sufficient spacing between the shadow masks to allow gasses to enter between the stacked masks to permit batch annealing of file stack of masks without having the stacked masks masks annealed to one another.

DESCRIPTION OF THE PREFERRED EMBODIMENT

Figure 1:
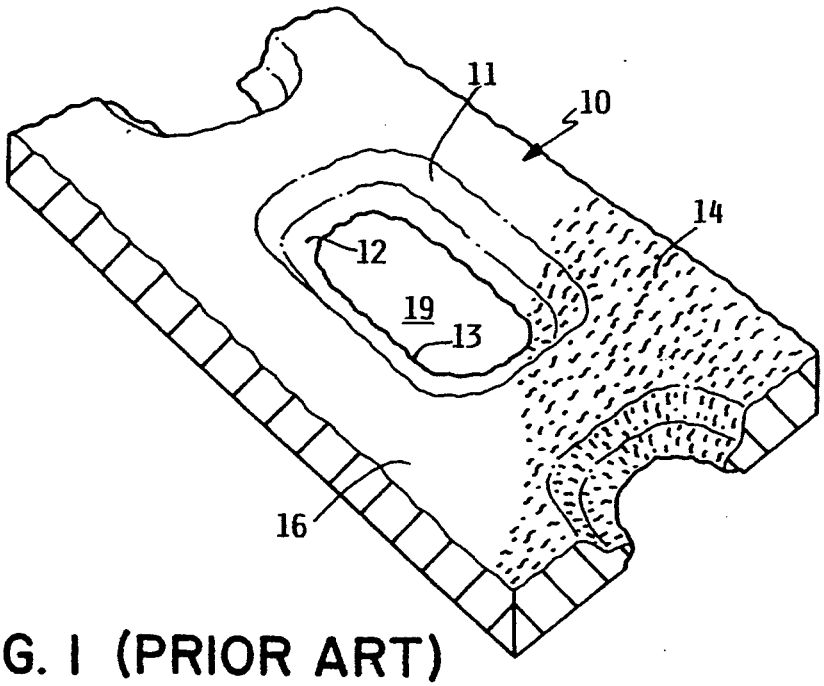
FIG. 1 (PRIOR ART)
FIG. 1 is a perspective view of a portion of a shadow mask showing the cone side of a prior an shadow mask with low acuity.

FIG. 1 reference numeral 10 generally identifies a portion of a prior art shadow mask with a cone side 16 of mask 10 facing upward. Located on cone side 16 of the mask 10 is a cone-shaped recess 11 having a bottom section 12 that is substantially parallel to the cone side surface 16 and an opening 19 defined by edge 13. The surface roughness $R_a$ of the texture of the shadow mask is indicated by reference numeral 14. While the roughness extends across the entire face of the mask for illustrative purposes only, a small portion has been shown.

Figure 2:
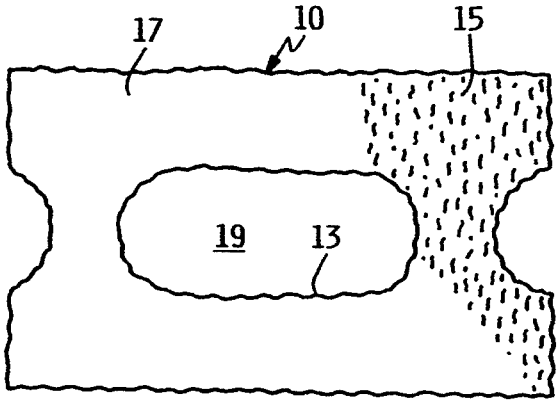
FIG. 2 (PRIOR ART)
FIG. 2 is a rear view of the mask of FIG. 1 showing the grade side.

FIG. 2 shows the opposite side of prior art shadow mask 10 showing grade side 17 of mask 10 having the same roughness $R_a$ as roughness $R_a$ (FIG. 1) on the opposite side of mask 10. The grade-side view shown in FIG. 2 clearly shows the lack of acuity around the edge 13 of opening 19 in shadow mask 10. In general the lack of acuity in the shadow mask 10 is a result of maintaining a high surface roughness in order to prevent seizing of the shadow masks during the batch annealing process. That is the value of $R_a$ may be 0.3 microns or greater to ensure that sufficient space is provided to prevent seizing of the shadow masks during batch annealing.

Figure 3:
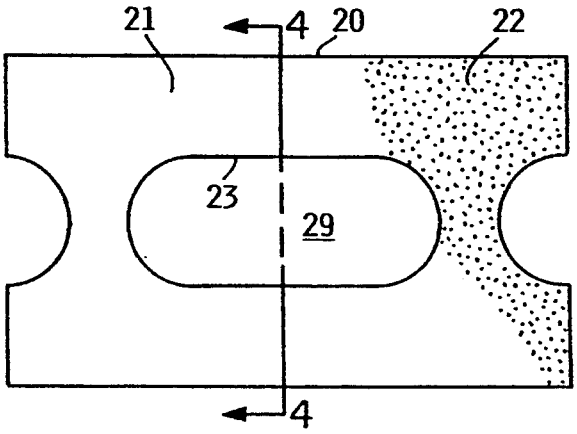
FIG. 3 is a grade-side view of a portion of a shadow mask with high acuity.

For comparative purposes, FIG. 3 shows a grade side 21 of a portion of mask 20 made with the present invention which has been annealed with a batch annealing process. FIG. 3 shows grade side portion of shadow mask 20 with a surface roughness texture indicated by 22. The roughness indicated by 22 extends across the entire mask however, only a portion has been illustrated. Note, the acuity of the opening 29 of shadow mask 20 in comparison to the acuity of the opening 19 in shadow mask 10 in FIG. 2. When comparing FIGS. 2 and 3 is apparent in that the edges of opening 23 are sharp and well defined whereas the edges 13 are poorly defined as a result of the surface roughness on mask 10.

Figure 4:
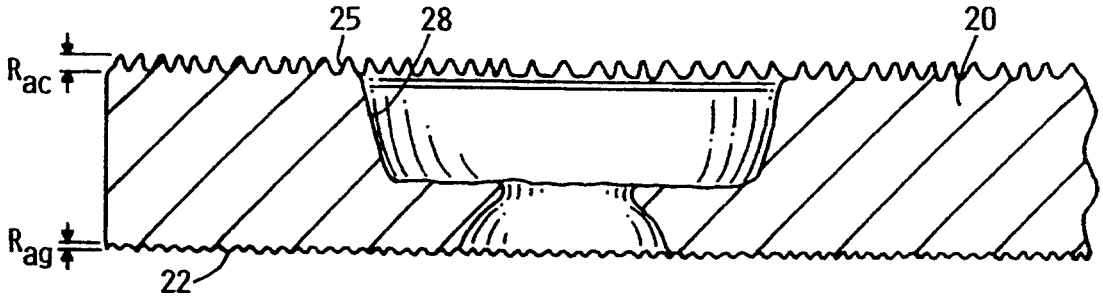
FIG. 4 is a sectional view along lines 4—4 in FIG. 3.

FIG. 4 shows a cross-sectional view taken along 4—4 of FIG. 3 and illustrates in more detail a portion of the shadow mask and the roughness of the opposite surfaces of the mask. Reference numeral 25 indicates the cone-side of shadow mask 20 mask with the cone side roughness identified by $R_{ac}$ whereas reference numeral 22 indicates the grade side roughness identified by $R_{ag}$. The term "$R_a$" is a term of the industry used to identify the average centerline roughness of the surface of the shadow mask. In embodiment shown $R_{ag}$ on the grade side has a value of 0.1 microns and the roughness on the cone side $R_{ac}$ has a value of about 0.6 microns. It is apparent that there is a substantial difference between the surfaces finishes of the grade side and the cone side of the mask.

Figure 5:
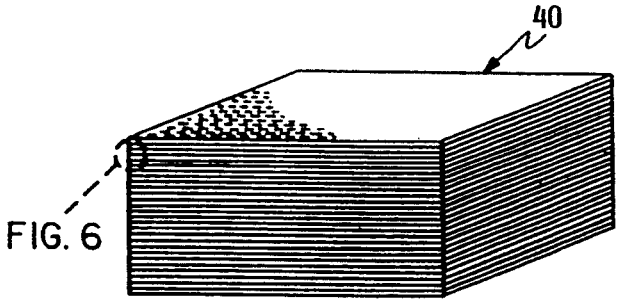
FIG. 5 shows a stack of aperture masks for batch annealing.

FIG. 5 shows a plurality of shadow masks 20 which have been stacked on top of one another to form a stack 40 for annealing.

Figure 6:
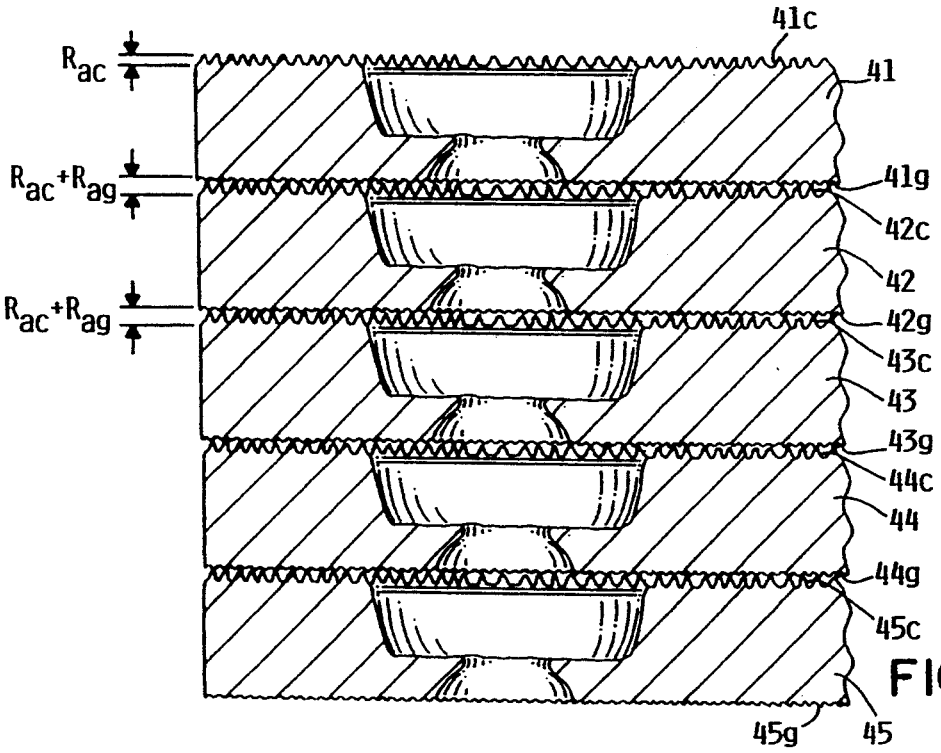
FIG. 6 shows an enlarged view of the portion of the shadow mask for batch annealing.

FIG. 6 shows a blown-up view of a portion of the stacks of shadow masks FIG. 5 illustrating shadow masks 41, 42, 43, 44 and 45 and their stacked relationship to each other. As can be seen, shadow mask 41 has a grade side **41*g* which contacts cone side 42*c* of mask 42. Similarly, shadow mask grade side 42*g* contacts code side 43*c* of shadow mask 43 and shadow mask grade side 43*g* contacts code side 44*c* of shadow mask 44 and so on. Consequently, the stacking of the shadow masks with the cone side contacting the grade side ensures that the maximum average roughness $R_{ac}$ and $R_{ag}$ is the minimum spacing on the opposite side, thereby ensuring that all the shadow mask will have sufficient separation so that gasses can flow between the aperture masks during the annealing process. Thus while the prior art suggested having the value of $R_a$ on both sides of the mask between 0.3 and 0.7 microns the present invention maintains only one side with A roughness $R_a$ equal to or greater than $R_a$=0.3 microns. It has been found that the shadow masks 40**, which are annealed at a temperature range of 750 degrees–950 degrees Celsius, do not adhere to one another during the annealing process if the cone side roughness is maintained as described herein. In one embodiment the shadow mask average centerline roughness $R_{ag}$ on the grade side of the mask is less than about 0.1 microns. In another embodiment the average centerline roughness $R_{ac}$ on the cone side of the mask is greater than about 0.7 microns and in some embodiments the average roughness $R_{ac}$ of the cone side is at least 0.5 microns greater than the average roughness $R_{ag}$ of the grade side.

I claim:

1. An shadow mask for use in forming a television tube comprising: a sheet of metal having a plurality of openings therein, said sheet of metal having a grade side and a cone side with said grade side located opposite of said cone side, said cone side characterized by having an average centerline roughness $R_{ac}$, said grade side characterized by having an average centerline roughness $R_{ag}$ which is less than the cone side average centerline roughness $R_{ac}$ to enable a plurality of shadow masks to be stacked on top of one another for batch annealing.

2. The shadow mask of claim 1 wherein $R_{ac}$ is about 0.6 microns.

3. The shadow mask of claim 1 wherein $R_{ag}$ is about 0.1 microns.

4. The shadow mask of claim 1 wherein the average centerline roughness $R_{ag}$ on the grade side of the mask is less than about 0.1 microns.

5. The shadow mask of claim 3 wherein the average centerline roughness $R_{ac}$ on the cone side of the mask is greater than about 0.7 microns.

6. The shadow mask of claim 1 wherein the average roughness $R_{ac}$ of the cone side is at least 0.5 microns greater than the average roughness $R_{ag}$ of the grade side.

7. A shadow mask for use in forming a television tube comprising: a sheet of metal having a plurality of openings therein, said sheet of metal having a cone side on one side of said sheet of metal and a grade side on the opposite side of said sheet of metal, said grade side having an average centerline roughness $R_{ag}$, said cone side having an average centerline roughness $R_{ac}$ which is greater than the average centerline roughness $R_{ag}$ so that when a plurality of aperture masks are stacked on top of one another, the grade side of one mask contacts the cone side of an adjacent mask to enable the roughness of the cone side $R_{ac}$ and the roughness $R_{ag}$ to form a passage way between stacked masks to allow gasses to enter between the stacked masks so one can batch anneal a stack of high acuity masks.

* * * * *

UNITED STATES PATENT AND TRADEMARK OFFICE

CERTIFICATE OF CORRECTION

PATENT NO. : 5,382,870

DATED : January 17, 1995

INVENTOR(S) : ROLAND H. THOMS

It is certified that error appears in the above-indentified patent and that said Letters Patent is hereby corrected as shown below:

On the Title page of the Patent in [57] Abstract at line 1 after "tube", insert --comprising a sheet of metal--

Col. 1, line 14, delete "mated", insert --coated--

Col. 1, line 53, delete "Dement", insert --Derwent--

Col. 2, line 9, delete "an", insert --art--

Col. 2, line 36, delete "file", insert --the--

Signed and Sealed this

Second Day of May, 1995

Bruce Lehman

*Attest:*

BRUCE LEHMAN

*Attesting Officer*

*Commissioner of Patents and Trademarks*